United States Patent [19]

Albrile

[11] 4,390,295

[45] Jun. 28, 1983

[54] CARRIAGE SUPPORT FOR TYPEWRITER

[75] Inventor: Walter Albrile, Turin, Italy

[73] Assignee: Ing. C. Olivetti & C., S.p.A., Ivrea, Italy

[21] Appl. No.: 132,394

[22] Filed: Mar. 20, 1980

[30] Foreign Application Priority Data

Mar. 22, 1979 [IT] Italy ..... 67589 A/79

[51] Int. Cl.[3] ..... B41J 19/00

[52] U.S. Cl. ..... 400/330.1; 400/268; 400/422; 400/445; 400/456; 400/637; 400/692

[58] Field of Search ..... 400/330, 330.1, 330.2, 400/330.3, 330.4, 330.5, 330.6, 330.7, 330.8, 331.1, 331.2, 331.3, 352, 354, 354.1, 354.2, 354.3, 357, 692

[56] References Cited

U.S. PATENT DOCUMENTS

| | | | |
|---|---|---|---|
| 975,101 | 11/1910 | Yaw | 400/357 |
| 1,127,216 | 2/1915 | Etheridge | 400/357 |
| 1,151,755 | 8/1915 | Bennett | 400/330.1 |
| 1,344,837 | 6/1920 | Wales | 400/354.3 |
| 1,382,349 | 6/1921 | Etheridge | 400/357 |
| 1,483,330 | 2/1924 | Broman | 400/357 |
| 1,510,797 | 10/1924 | Pfau | 400/692 |
| 1,594,768 | 8/1926 | Block | 400/694 X |
| 1,998,829 | 4/1935 | Avery | 400/330.8 X |
| 2,375,975 | 5/1945 | Crossman | 400/354 X |
| 2,881,896 | 4/1959 | Demmel | 400/692 X |
| 3,258,101 | 6/1966 | Decker | 400/330.8 |
| 3,724,632 | 4/1973 | Kuramochi | 400/330.8 |
| 3,730,323 | 5/1973 | Watanabe | 400/330.8 X |
| 3,799,312 | 3/1974 | Jozuka | 400/330.8 X |

FOREIGN PATENT DOCUMENTS

| | | | |
|---|---|---|---|
| 385747 | 12/1923 | Fed. Rep. of Germany | 400/354.1 |
| 2544429 | 2/1977 | Fed. Rep. of Germany | 400/357 |

*Primary Examiner*—Ernest T. Wright, Jr.

*Attorney, Agent, or Firm*—Schuyler, Banner, Birch, McKie & Beckett

[57] ABSTRACT

In a typewriter a carriage spacing mechanism is mounted on a support element to space a paper bearing carriage independently from a base structure and is connectable for assembly of the machine to a control means supported by the base structure. Keys, intermediate levers and type basket are assembled independently from the base structure and are fixed to the base structure only through the medium of a supporting block for the keys and fixing means for the type basket. A plate picks up the striking movement of the type bars and comprises a plurality of bearing elements disposed so as to cause the plate to rock about two pivot elements of the bearing elements and a cam portion which is dimensioned so as to regularize the stroke of a transmission element in dependence upon the particular type bar actuated for the striking. A kinematic mechanism and a carriage assembly are adapted to be mounted as subassemblies on the base structure and are provided with elements for transmitting motion which are disposed adjacent to the corresponding interconnecting elements for transmission of the operative commands by thrust.

8 Claims, 8 Drawing Figures

CARRIAGE SUPPORT FOR TYPEWRITER

BACKGROUND OF THE INVENTION

The present invention relates to a number of improvements in typewriters predominantly, but not exclusively, of the inexpensive type.

Reduction of the cost of typewriters at the low end of the market is generally obtained by effecting a lightening of the parts and a simplification of the kinematic chains and by using low-cost materials. The overall result suffers by the economies effected, for which reason both the quality of printing and the reliability of such a machine prove inferior to those of standard machines. Moreover, manufacturing processes employed in particular for machines of the hammer type provide for gradual assembly of the various parts on the machine in manufacture. This does not permit either rationalization of schedules, for machines of different models, or the use of machines for automatic assembly, causing a consequent increase in cost.

SUMMARY OF THE INVENTION

The object of the present invention is to provide typewriters, predominantly of inexpensive type, which have good performances in operation and which employ modular techniques of manufacture of the principal parts of the machine with a reduction of the total costs of manufacture.

According to a first characteristic, the typewriter according to the invention comprises a carriage shift mechanism mounted on a supporting element in such manner as to form a carriage module which is operative independently from the base structure, and adapted to be connected afterwards to a control means on the base of the machine during the assembly of the various modules.

According to another characteristic, the machine comprises a supporting block for the keys and fixing means for the type basket, and the keys, the intermediate levers and the type basket are assembled independently from the base structure of the machine and are fixed to the said structure only through the medium of the supporting block and the fixing means for the basket.

According to a further characteristic, the machine comprises a plate for picking up the striking movement of the type bars, a plurality of bearing elements for the plate which are disposed so as to cause it to rock about two pivot elements of the said plurality and a cam portion of the said plate which is dimensioned so as to regularize the stroke of an element which transmits the movement of the said plate irrespective of the actual stroke of the type bar actuated for striking.

BRIEF DESCRIPTION OF THE DRAWING

These characteristics and other characteristics of the invention will become clear from the following description of a preferred embodiment given by way of example, but non-limitatively, and from the accompanying drawing in which.

DESCRIPTION OF THE PREFERRED EMBODIMENT

Figure 1:
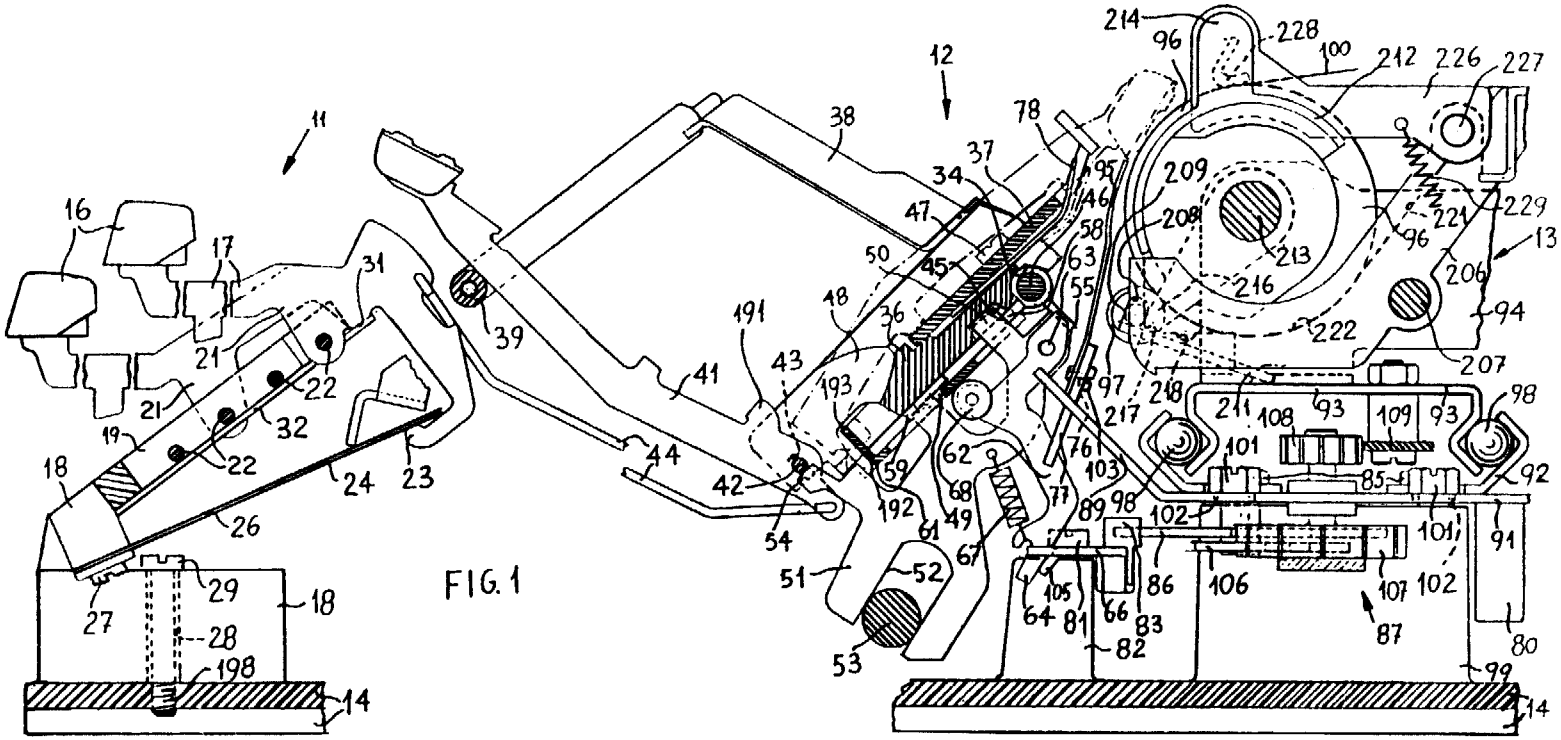
FIG. 1 is a partial longitudinal section of a typewriter according to the invention.

Referring to FIG. 1, the typewriter comprises a series of modules: keyboard 11, kinematic printing mechanism 12, carriage 13 and base structure 14.

The keyboard module 11 comprises a set of printing and function keys 16, each of which is mounted on a key lever 17. The levers 17 are arranged in a support 18 in the form of a comb having a series of slots 19, in each of which is guided a lug 21 of the corresponding key lever 17. The key levers 17 are pivoted on four spindles 22 of the support 18 and each of them comprises an end 23 adapted to cooperate with a tongue 24 formed integrally from a leaf spring 26 fixed to the support 18 by means of screws 27, only one of which can be seen in the drawing. The support 18 has two slotted holes 28 adapted to accommodate corresponding screws 29 for fixing the support 18 to the base structure 14. The tension of the tongues 24 keeps the respective key lever 17 in the inoperative position arrested by a shoulder 31 against a plate 32 of the support 18.

The kinematic printing mechanism 12 comprises a set of type bars 41 and an ordinary type basket 36, with a type bar guiding fork 37, and arms 38 (only one can be seen in the drawing) adapted to support a bearing element 39 on which the type bars 41 are normally borne. Each type bar 41 is pivoted on a curvilinear spindle 42 housed in a seat 43 in the basket 36 and is connected to the respective key lever 17 by means of a tie rod 44.

A spindle 46 is fixed to the basket 36 and the fork 37 through the medium of a recess 34 in the basket 36 and four screws 47. The basket 36, which is made, for example, of light alloy, comprises a series of slots 48 each adapted to accommodate the respective type bar 41. Fixed to the basket 36 by means of a screw 49 is a plate 51 provided with a guide slot 52 engaging a corresponding shaft 53. The plate 51 moreover has a cam end 54 bearing against the central part of the spindle 42, a bent portion 55 bearing against the spindle 46, and a lug 50 in a notch 45 in the basket 36 for precise fitting or engagement of the guide slot 52 with respect to the type bars 41.

Figure 5:
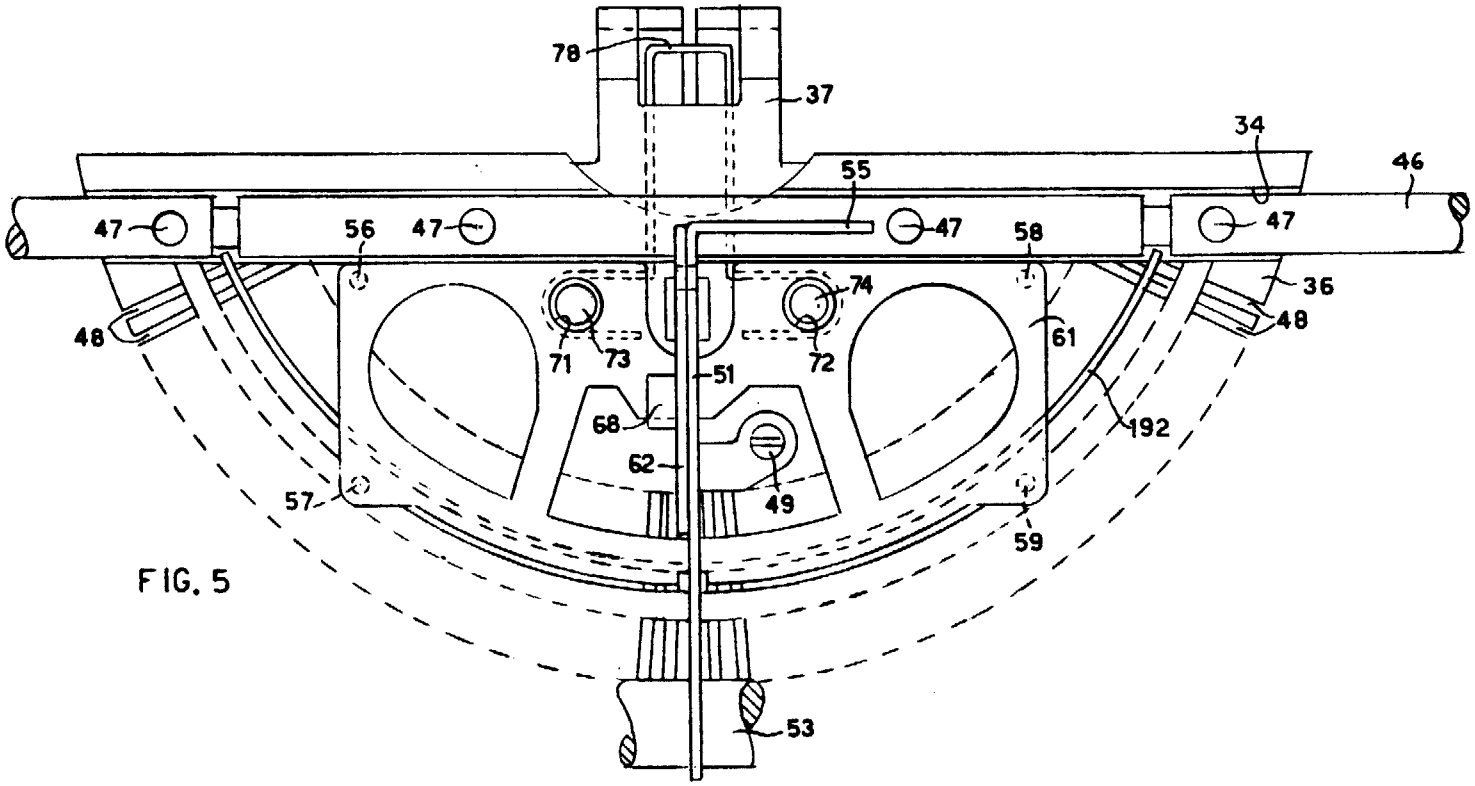
FIG. 5 is a partial front view of a number of details of FIG. 1 on a larger scale.

In its rear part, the basket 36 has four shoulders or bearing elements 56, 57, 58 and 59 (FIG. 5) on which a control plate 61 normally bears. A transmission lever 62 (FIG. 1) is pivoted on the plate 51 by means of a pin 63. A spring 67 normally keeps the lever 62 turned clockwise with a roller 68 bearing against the control plate 61, so that the plate 61 is arrested against the shoulders 56, 57, 58 and 59 (FIG. 5) of the basket 36. In turn, the control plate 61 has two holes 71 and 72 in which are housed with a clearance two guide pins 73 and 74, respectively, fixed to the type bar guiding fork 37 and which ensure the guiding connections between the basket 36 and the plate 61. Over the pins 73 and 74 (FIG. 5) there is moreover hooked a spring 78 constituted by a wire in the shape of a T and adapted to cooperate with the type bars 41 during the typing or printing stage.

Figure 4:
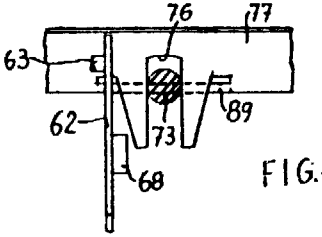
FIG. 4 is a partial front view of a number of details of FIG. 3.

The carriage module 13 (FIG. 1) comprises a supporting element constituted by a bottom plate 91 on which are mounted an escapement mechanism 87, a fixed guide 92 secured to the bottom plate 91 by means of screws 85, and a movable guide 93. By means of two uprights 94 (only one can be seen in the drawing), the guide 93 bears a paper cylinder or platen 96 and it is slidable on the fixed guide 92 by means of a series of balls 98. The carriage module 13 is fixed to the base structure 14 by means of the bottom plate 91, which rests on two lateral supports 99 (only one can be seen in the drawing) projecting from the base structure 14. To this end, two pairs of screws 101 (one pair can be seen in the drawing) engage in slotted holes 102 in the bottom plate 91 and lock the plate 91 to the supports 99. The bottom plate 91 is provided with a front flange 89 bent at 45° and on which there projects a subvertical bent portion 77. This bent portion 77 is provided with a slot 76 (FIG. 4) having a vertical axis and engaging in turn, with a precise sliding coupling action, the pin 73 of the type bar guiding fork 37. Moreover, a paper guide 95 adapted to guide a sheet of paper 100 is fixed to the bent portion 77 (FIG. 1) by means of screws 103. A bottom paper guide 206 (FIG. 1) pivoted by means of a pair of pins 207 (only one can be seen in the drawing) on the uprights 94 and has an inclined surface 221 which joins up with a circular surface 222 adjacent the platen 96. The paper guide 206 moreover has a pair of slots 208 adapted to accommodate the ends of a shaft 209 on which paper gripping rollers 97 are mounted. A two-armed torsion spring 211 fixed to the movable guide 93 engages the ends of the shaft 209 with its arms, pushing them along the slots 208 into the proximity of the bottom thereof until the rollers 97 are arrested against the platen 96.

A control element 212 is rotatable on a spindle 213 of the platen 96 and comprises a grip 214 and a projection 216 which is adapted to be accommodated in two seats 217 and 218 in the paper guide 206. FIG. 1 shows the paper guide 206 with the seat 217 engaged by the projection 216 in the position in which the sheet of paper 100 is held by the surface 222 against the platen 96. By turning the control element 212 anticlockwise by means of the grip 214, the projection 216 leaves the seat 217 and tends to cause the paper guide 206 to turn anticlockwise and, by means of the bottom of the slots 208, tends to move the shaft 209 and the rollers 97 away from the platen 96 in opposition to the action of the spring 211 to assist in this way the insertion of the sheet of paper 100. In this position, the spring 211 keeps the paper guide 206 turned anticlockwise, with the seat 218 arrested against the projection 216, which in this way acts as a locating means for the element 212.

The paper guide 206 has two arms 226 (only one can be seen in the drawing) which can turn on the pins 227 and fixed to a U-shaped paper gripping plate 228. A pair of bistable springs 229 hold the arms 226 and the plate 228 turned anticlockwise and arrested with the plate 228 against the platen 96, or, alternatively, turned clockwise with the plate 228 at a distance from the platen 96.

Figures 2, 7:
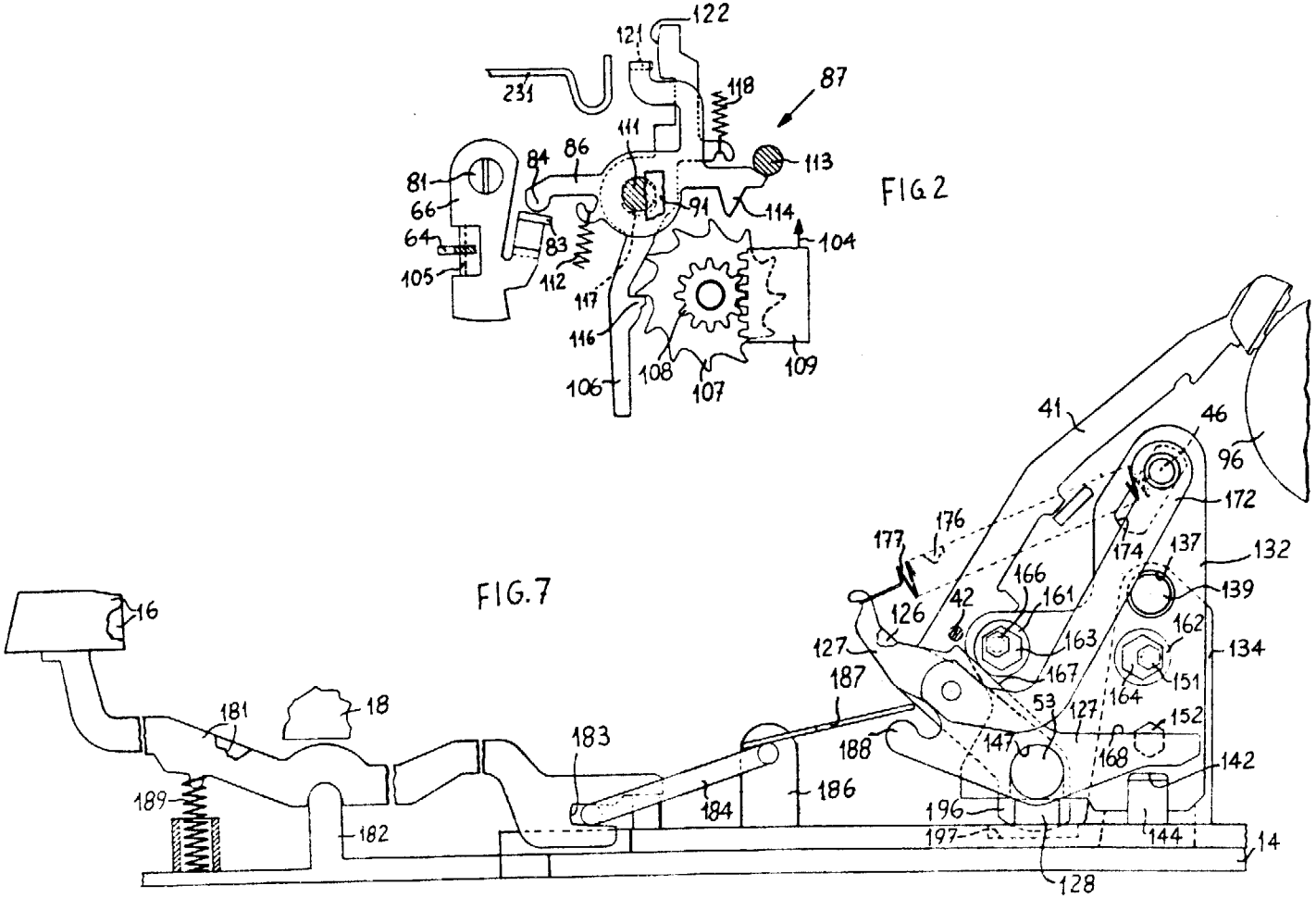
FIG. 2 is a partial plan view of a number of details of the machine of FIG. 1.
FIG. 7 is a second partial longitudinal section of the machine of FIG. 1.
Figure 8:
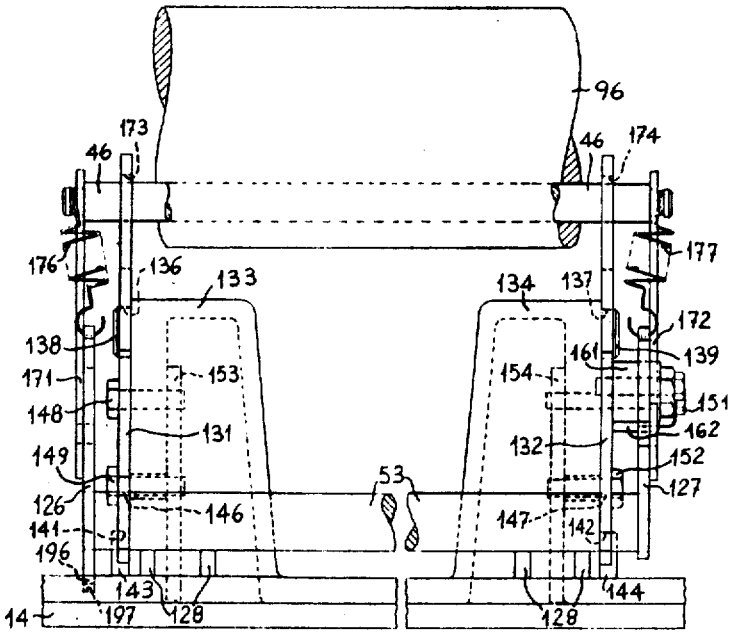
FIG. 8 is a partial front view corresponding to FIG. 7.

The escapement mechanism 87 (FIG. 1), which is of known type, comprises a carriage draw spring 80, a fixed-tooth lever 86, a movable-tooth lever 106 and a toothed wheel 107 connected to a pinion 108 in mesh in turn with a rack 109 on the movable guide 93. In its inoperative position, the escapement mechanism 87 is as shown in FIG. 2, in which the fixed-tooth lever 86, which can turn about a pin 111 under the action of a spring 112, is arrested against a stop 113 with a tooth 114 out of the path of the toothed wheel 107. The movable-tooth lever 106 is normally engaged by means of a tooth 116 with the toothed wheel 107, locking it in opposition to the action of the carriage draw spring 80 indicated by the arrow 104, while the bottom of a slot 117 is arrested against the pin 111, overcoming the action of a spring 118. The lever 86 is arranged with a shoulder 84 thereof in front of a lug 83 of an intermediate lever 66 which can turn through the medium of a pin 81 on a support 82 of the base structure 14 (FIG. 1) and cooperating in turn by means of a lug 105 with one end 64 of the transmission lever 62. The shaft 53 (FIG. 8) is normally supported on four shoulders 128 projecting from the plastics base structure 14 and is positioned longitudinally by two flanges 131 and 132 fixed to two hollow supports 133 and 134 projecting from and integral with the base structure 14. Each of the flanges 131 and 132 is positioned exactly against the respective supports 133 and 134 by means of holes 136 and 137 which accommodate studs 138 and 139 on the said supports 133 and 134 and is positioned at the bottom by means of first slots 141 and 142, respectively, which accommodate guide elements 143 and 144 on the base structure 14. The locking of each of the flanges 131 and 132 to their respective supports 133 and 134 is ensured by bolts 148 and 149 and 151 and 152, respectively, passed through the supports 133 and 134 and screwed into sectors 153 and 154. A second slot 146 and 147 in each of the flanges 131 and 132, respectively, is adapted to accommodate one end of the shaft 53, nevertheless allowing the possibility of rotation.

The shaft 53 is fast with two levers 126 and 127 fixed at the ends of the said shaft 53. Moreover, two eccentrics 161 and 162 (FIG. 7) are mounted on the flange 132 by means of bolts 166 and 151, each of the eccentrics 161 and 162 comprising a hexagonal adjusting portion 163, 164, respectively. The lever 127 is a rocking lever and has two shoulders 167 and 168 adapted to cooperate with the eccentrics 161 and 162, respectively. The eccentric 161 adjusts the position of the lower-case plane, while the eccentric 162 adjusts the position of the upper-case plane, as will be described hereinafter.

Two connecting rods 171, 172 (FIG. 8) are each pivoted at one end to the corresponding lever 126, 127 and at the other end to the corresponding end of the spindle 46. The ends of the spindle 46 are guided in turn in slots 173, 174 in the flanges 131 and 132. The slots 173 and 174, together with the connecting rods 171 and 172 and the levers 126 and 127, ensure movement of the spindle 46 parallel to the axis of the platen 96. Two springs 176 and 177 are stretched between the ends of the levers 126 and 127 (FIG. 7) and the ends of the spindle 46, forming a toggle joint which keeps the levers 126 and 127 turned clockwise and arrested by the shoulder 167 against the eccentric 161 with the spindle 46 in the raised position, that is in the lower-case position of the type bars 41 (FIG. 7).

The function keys 16 for the shift from lower case to upper case are fixed on key levers 181 which are fulcrumed between a support 182 on the base structure 14 and the key support 18 and comprise a slot 183 adapted to accommodate the ends of a lever constituted by a shaped round rod 184 pivoting on a support 186 on the base structure 14. Fixed to the lever 184 is a leaf spring 187 adapted to cooperate with an end 188 of the lever 127. A spring 189 normally keeps the spring 187 disengaged from the end 188. By depressing the key 16, the lever 181 turns anticlockwise in opposition to the action of the spring 189, the lever 184 turns clockwise and the leaf spring 187 engages the end 188. The action of the spring 187 prevails over the action of the springs 176 and 177, so that the levers 126 and 127 are rotated anticlockwise. The levers 126 and 127 and the connecting rods 171 and 172 lower the spindle 46 until such time as the shoulder 168 is arrested against the eccentric 162 in the upper-case position of the type bars 41. By ceasing the pressure on the shift key 16, the springs 189, 176 and 177 bring the whole assembly back to rest and raise the spindle 46 into the lower-case position shown in FIG. 7.

Figure 6:
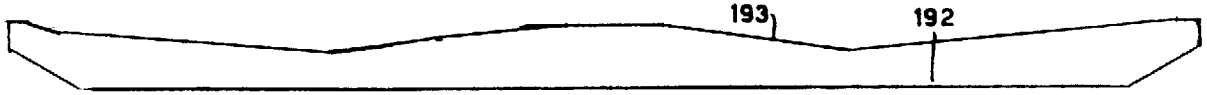
FIG. 6 represents a development of a detail of FIG. 5 in a horizontal plane.

Each type bar 41 (FIG. 1) is provided with a projection 191 adapted to cooperate in the striking stage of the type bar 41 with a curved strip 192 of semicircular section projecting from the control plate 61 and turned towards the type bars 41 in their inoperative position. The strip 192 (FIG. 5) is parallel to the spindle 42 and coaxial with the type basket 36 to cooperate with all the type bars 41 of the basket 36. The edge of the strip 192 has a cam profile 193, the development of which, shown in FIG. 6, presents projections and recesses calculated in such manner as to obtain a constant rotation of the lever 62 during the striking of each type bar 41, as will be described hereinafter.

In accordance with the invention, the various parts hereinbefore described can be mounted in several operative units or modules, such as the keyboard 11 (FIG. 1), with the kinematic printing mechanism 12, and the carriage 13, which are independent from the base structure 14. Only at the end of their assembly are these units simply mounted on the base structure 14 with very few adjustments and rationalizing working schedules and the administration of supplies.

The assembly of the kinematic printing mechanism module 12 and the keys 16 (FIG. 1) is carried out along a line different from that for the base structure 14 by mounting on the basket 36 all the parts connected thereto, such as the spindle 46, the toggle joint, the shaft 53, the fork 37 and, finally, the type bars 41. The keys 16 are mounted on the support 18 and connected to the type bars 41 by means of the tie rods 44 by forming a "cluster", from the keys 16 to the type bars 41, which can be moved, for example, suspended from an assembly chain. This module, which is specific as regards the font and as regards the arrangement of the keys 16 is thus completed and can be moved or be stored separately.

The assembly of the carriage module 13 provides for the fitting of the unit 87 and the guide 92 to the plate 91. On this there is mounted the movable guide unit 93 with the platen 96, the paper guide 206, etc. and those parts which have neither been described, nor are shown in the drawing. Since the module 13 is complete, it is tested to check correct operation thereof. These modules 12 and 13, which are specific, for example, as regards the step or as regards the length of the platen 96, are also moved and stored in convenient lines.

The assembly of the base module provides for arrangement on the base structure 14 of the few interconnecting parts, such as the control lever 66, the lever 184 and a push rod 231 (FIG. 2) of a space bar (not shown) and those parts which define other special features of the machine, with the same considerations which have been stated with regard to the other two modules 12 and 13.

On the line for the assembly of the complete machine, the kinematic printing mechanism 12 is arranged on the base structure 14 so that the slot 52 of the plate 51 is in engagement with the shaft 53, the flanges 131 and 132 are alongside the supports 133 and 134 (FIGS. 7 and 8) and the shaft 53 is on top of the supports 128. By means of the sectors 153 and 154 and the screws 148, 149, 151 and 152, the basket 36 is mounted in this way on the base structure 14. Since the flanges 131 and 132 engage the studs 138 and 139 and the elements 143 and 144 are precise reference points, after the tightening of the bolts 148, 149, 151 and 152 the basket 36 is perfectly adjusted, both as regards orientation and in the longitudinal plane. Moreover, another reference point for the shaft 53 is provided by one end 196 of the lever 126, which is accommodated in a slot 197 in the base structure 14.

The support 18 is now positioned on the base structure 14 by fitting the screws 29 in the slotted holes 28, shifting the support 18 forward or backward until the tie rods 44 position the shoulders 31 of the levers 17 on the plate 32, with the type bars 41 bearing against the bearing element 39, and finally tightening the screws 29 into the threaded holes 198 in base structure 14.

Figure 3:
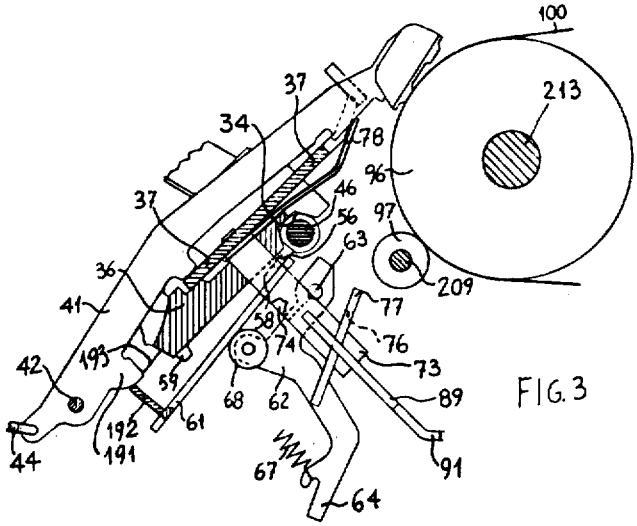
FIG. 3 is a partial longitudinal section of other details of FIG. 1 in a working position.

The carriage assembly 13 is positioned on the supports 99 so that the pin 73 (FIGS. 3 and 4) is located in the slot 76 in the bent portion 77. This defines precisely the transverse distance of the fork 37 with respect to the printing point of the platen 96. The four screws 101 (FIG. 1) are now screwed into the supports 99 and the working position of the kinematic printing mechanism 12 is checked by actuating the keys 16 with the shift levers 181 (FIG. 7) in the lower-case position. The bottom plate 91 (FIG. 1) with the slotted holes 102 allows the carriage 13 to be positioned forward or backward, after slackening and tightening the screws 101, until perfect alignment and correct impression of the characters printed by the type bars 41 are obtained over the entire length of the platen 96.

The height of the lower-case and upper-case types and their uniformity of striking with respect to the printing line are now checked by acting on the eccentrics 161 and 162 (FIG. 7). By means of the spring 187 and the end 188, the shift lever 181 turns the lever 127 anticlockwise in opposition to the action of the springs 176 and 177, causing the shoulder 168 to be arrested against the eccentric 162. By depressing the printing keys 16, the regularity of the characters printed along the printing line is checked. The bolt 151 is now slackened and by acting on the hexagonal portion 164 the eccentric 162 is turned clockwise or anticlockwise until the upper-case characters are completely regular. The bolt 151 is then tightened. The striking of the type bars 41 is repeated in the lower-case position, with the lever 127 arrested against the eccentric 161. For lower-case adjustment, the bolt 166 is slackened and by acting on the hexagonal portion 163 the eccentric 161 is turned clockwise or anticlockwise, the same procedure being followed as for the upper-case adjustment previously described.

On depressing a key 16 (FIG. 1), the tongue 24 is bent and the tie rod 44 is drawn forward and causes the type bar 41 to rotate for striking. The projection 191 engages the profile 193 of the strip 192, causing the plate 61 to move towards the platen 96, the plate 61 pivoting or being fulcrumed on two of the four shoulders 56, 57, 58 and 59 and turning the control lever 62 (FIG. 3) anticlockwise. More particularly, according to whether the type bars 41 belong to the central sector or to the lateral sectors, the plate 61 will pivot or rock on the shoulders 56 and 58, or on the shoulders 56 and 57 (FIG. 5), in the case of the type bars 41 on the left, or the shoulders 58 and 59, in the case of the type bars 41 on the right, respectively. In each case, the cam profile 193 ensures that the striking movement of all the type bars 41 will shift the central point of the plate 61 by a constant amount. Moreover, the engagement between the end 64 of the lever 62 and the lug 105 is of sliding type, as a result of which any movement of the basket 36 for the shift does not affect the connection between the plate 61 and the lever 86.

The lever 62 (FIG. 1) turns anticlockwise and by means of the end 64 engages the lug 105 of the lever 66, which in turn (FIG. 2) causes the fixed tooth 116 to rotate and, through the medium of the lug 121 and the shoulder 122, inserts the tooth 114 in the path of the toothed wheel 107.

The tooth 116 is disengaged from the wheel 107 and the carriage draw spring 80 acts by means of the rack 109 and the pinion 108 until the carriage 13 shifts by about half a step. On releasing the key 16, the tongue 24 brings the corresponding key lever 17 back to rest with its respective type bar 41 and the spring 67 brings the control plate 61 back to rest. The spring 112 (FIG. 2) now rotates the lever 86, disengaging the tooth 114 from the wheel 107, while the spring 118 rotates the corresponding lever 106, bringing the tooth 116 into the path of the wheel 107. The carriage draw spring 80 then completes the movement of the carriage 13 (FIG. 1) by one step, while the intermediate lever 66 adopts an intermediate position defined by the shoulder 84 and the end 64 (FIG. 1) of the lever 62.

The shifting of the carriage 13 can also be obtained by the thrust action of the push rod 231 on the shoulder 122 of the lever 106 in the same manner as has just been described.

I claim:

1. A typewriter of the type comprising a type bar basket having a plurality of type bars and a guiding fork for a striking type bar; a base structure mounting said type bar basket; a carriage module including a carriage transversely movable with respect to said fork, wherein said carriage module has a movable guide, a platen mounted on said movable guide, and a fixed guide for slidably supporting said movable guide; at least one spacing command member supported by said base structure and operable by the striking type bar for commanding the spacing of said platen; a carriage spacing mechanism including a draw spring connected to drive said movable guide, a rack mounted on said movable guide, a pinion in engagement with said rack, a spacing toothed wheel bodily connected with said pinion and a spacing tooth engaging with said spacing toothed wheel and wherein said spacing tooth is actuatable to release said toothed wheel and re-engage said toothed wheel for effecting the spacing of said platen; mounting means for mounting together said carriage module and said carriage spacing mechanism as a unit, wherein said unit operates to guide and space said platen with respect to said fixed guide independently from said base structure; and fixing means for exactly fixing said unit on said base structure; wherein said mounting means comprise a support plate mounting said draw spring, said fixed guide, said pinion and said spacing tooth; wherein said fixing means comprise a coupling slot on said support plate for coupling a pin member fixed on said type bar basket adjacently to said fork and locking screws locking said support plate on said base structure; and wherein said fixing means put said spacing tooth in front of said at least one spacing command member for causing said tooth to be actuated by said command member.

2. A typewriter according to claim 1 further comprising a control plate mounting a universal frame for picking up the striking movement of the striking type bar and an intermediate lever for transmitting the movement of said control plate, wherein said spacing command member comprises a command lever pivoted on said base structure and wherein said command lever includes an end operative on said spacing tooth and a part cooperative with said intermediate lever.

3. A typewriter according to claim 2, wherein said control plate comprises two holes wherein one of said two holes is guided with clearance by said pin member, and wherein the other of said two holes is guided by a second pin member fixed on said type bar basket, wherein said control plate further comprises four bearing elements, wherein said intermediate lever is urged by a spring and holds said bearing elements arrested against four corresponding shoulders of the type bar basket, and wherein said bearing elements are disposed so as to cause said control plate to rock about two bearing elements of said four bearing elements in dependence upon the position of the striking type bar on said type bar basket.

4. A typewriter according to claim 3, wherein said universal frame comprises a curved lamina having a first edge fixed to said control plate and a second edge which has a cam profile so dimensioned as to regularize the stroke of said intermediate lever irrespective of the position of said striking type bar on said type bar basket.

5. A typewriter according to claim 2, wherein said spacing tooth comprises a first lever fulcrumed on a pin of said support plate, and wherein a first spring holds said first lever arrested against said spacing toothed wheel, further comprising a stop mounted on said support plate, a second lever fulcrumed on said pin and a second spring for holding said second lever arrested against said stop, wherein said second lever comprises a shoulder for cooperating with the end of said spacing command member, a holding tooth engageable with said spacing toothed wheel and a lug for cooperating with a shoulder of said spacing tooth, wherein said second lever is actuatable by said spacing command member to move said spacing tooth through said lug and said shoulder and to cause said holding tooth to engage with said spacing toothed wheel when said spacing tooth releases said toothed wheel.

6. A typewriter according to claim 5, wherein a push rod of said base structure is actuatable to engage with said lug to move said spacing tooth independently from said spacing command member.

7. A typewriter according to claim 1, further comprising a shaft and two flanges with a slot mounted on said base structure, a spindle and a member with a guide slot mounted on said type bar basket, wherein said type bar basket is movable for a shift from lower case to upper case, wherein said basket is guided by said spindle which engages with the slots of said two flanges and by the guide slot of said member which engages with said shaft and wherein the movement of said type bar basket causes said pin member to slide along the coupling slot of said support plate.

8. A typewriter according to claim 1, further comprising a sheet of paper disposed on said platen and a paper guide fixed on said carriage module for guiding the sheet of paper on said platen, said paper guide being disposed between said type bar basket and said platen.

* * * * *